US007185568B1

(12) United States Patent
Vance

(10) Patent No.: US 7,185,568 B1
(45) Date of Patent: Mar. 6, 2007

(54) ADJUSTABLE SOCKET WRENCH EXTENSION

(76) Inventor: Frank Vance, 2550 Nesmith Lake Blvd., Akron, OH (US) 44314

( * ) Notice: Subject to any disclaimer, the term of this patent is extended or adjusted under 35 U.S.C. 154(b) by 23 days.

(21) Appl. No.: 11/209,387

(22) Filed: Aug. 24, 2005

(51) Int. Cl.
*B25G 1/04* (2006.01)

(52) U.S. Cl. ..... 81/177.2; 81/177.85; 81/900; 403/330; 16/110.1

(58) Field of Classification Search ..... 81/177.2, 81/177.85, 177.1, 177.6, 900, 489; 403/109.1, 403/330; 16/110.1, 111.1, 405
See application file for complete search history.

(56) References Cited

U.S. PATENT DOCUMENTS 4,905,548 A * 3/1990 Colace et al. ..... 81/177.2
4,960,015 A * 10/1990 Mathews ..... 81/177.2
5,033,337 A 7/1991 Thomas, III
5,138,911 A 8/1992 Lan
5,690,006 A 11/1997 Pulliam
5,927,161 A * 7/1999 Clifford et al. ..... 81/177.2
6,170,365 B1 * 1/2001 Zerver ..... 81/177.85
6,971,290 B1 * 12/2005 Ybarra ..... 81/177.2

* cited by examiner

*Primary Examiner*—Lee D. Wilson
*Assistant Examiner*—Anthony Ojini
(74) *Attorney, Agent, or Firm*—John D. Gugliotta

(57) ABSTRACT

An apparatus is provided that allows the use of a standard ratchet wrench with a square male drive on one end that attaches to a normal socket and a square female drive on the other end which attaches to a normal socket wrench. The apparatus then provides a wrench slider component to provide increased length to reach.

6 Claims, 2 Drawing Sheets

ADJUSTABLE SOCKET WRENCH EXTENSION

RELATED APPLICATIONS

There are no previously filed, nor currently any co-pending applications, anywhere in the world.

BACKGROUND OF THE INVENTION

1. Field of the Invention

The present invention relates generally to socket wrenches and, more particularly, to a linearly extendable socket wrench adapter.

2. Description of the Related Art

As anyone who performs a lot of mechanical work will attest, nothing beats having the proper tool for a job. The proper tool can save time, save money, produce a higher quality job, reduce damage to equipment, and provide for the increased safety of the worker. One tool that is found in many lines of work is that of the socket wrench. These cylindrical shaped wrenches with a receiving cup are used on bolts to remove or tighten them. Their design, however, is prone to several problems. First, they are held in one's hand, making their applications limited in confined areas where one cannot get their hand. Secondly, their short handle length makes it difficult to apply even a moderate amount of leverage to remove or tighten stubborn bolts.

Consequently, a need has been felt for providing a socket adapter for connection to a socket wrench in a manner that provides for increased linear extension.

SUMMARY OF THE INVENTION

It is therefore an object of the present invention to provide an improved socket wrench adapter.

It is a feature of the present invention to provide an improved socket wrench adapter that is linearly extendable.

Briefly described according to one embodiment of the present invention, an apparatus is provided that allows the use of a standard ratchet wrench with a square male drive on one end that attaches to a normal socket and a square female drive on the other end which attaches to a normal socket wrench. The invention then provides a wrench slider component to provide increased length to reach.

An advantage of the present invention is that it allows use of socket wrenches in confined quarters where it is difficult or impossible to get one's hand on the wrench.

The use of the present invention further provides users of socket wrenches an adaptable extension to reach into tight locations in a manner which is not only quick, easy and effective, but safe as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
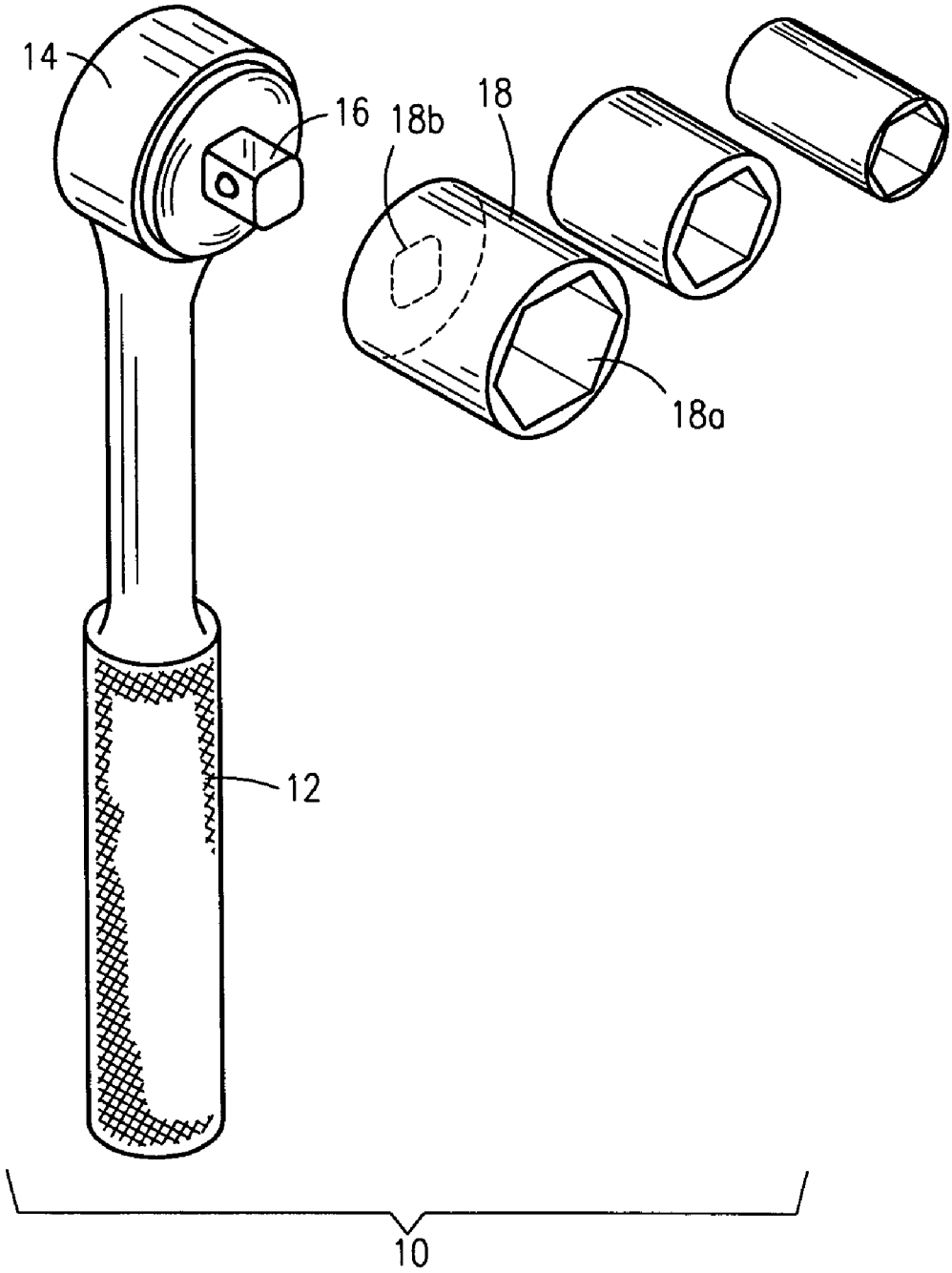
PRIOR ART Fig. 1
FIG. 1 is a perspective view of an otherwise conventional ratchet wrench 10 according to the PRIOR ART.
Figure 2:
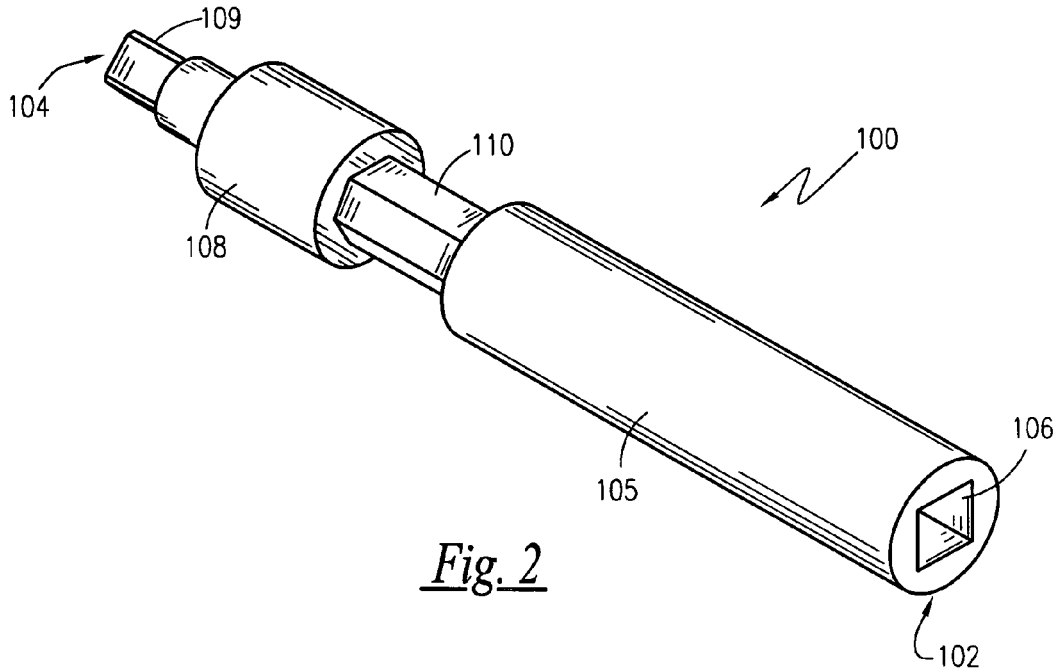
FIG. 2 is a perspective view of a linearly extendable socket wrench adapter according to the preferred embodiment of the present invention.
Figure 3:
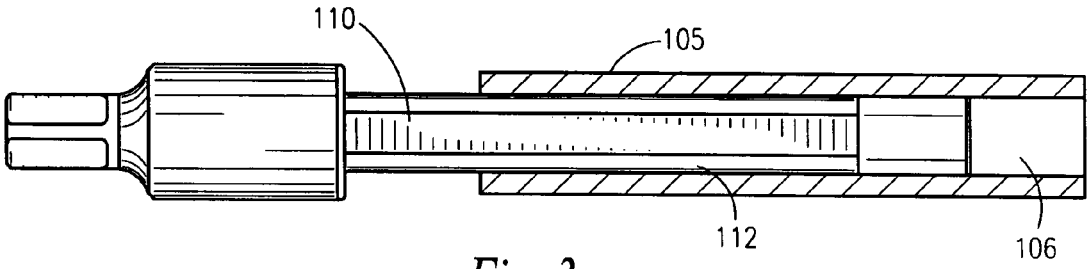
FIG. 3 is a cross sectional view taken along the linear centerline axis thereof.
Figure 4:
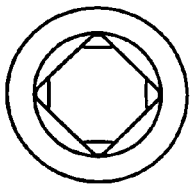
FIG. 4 is a front view of the male end thereof.
Figure 5:
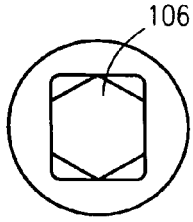
FIG. 5 is a rear view of the female end thereof.

In order to describe the complete relationship of the invention, it is essential that some description be given to the manner and practice of functional utility and description of the PRIOR ART, as shown in conjunction with FIG. 1. An otherwise conventional ratchet wrench 10 is generally available having an elongated handle 12 extending radially from a rotating head 14. The rotating head 14 supports an attachment protuberance 16 that removably affixes to a socket 18 selected from a plurality of such units. Each socket 18 includes a recess or cavity 18*a* adapted to receive a specific size nut or bolt head. All sockets 18 include an attachment recess 18*b* of a common size that allows receiving of the attachment protuberance 16 for purposes of providing a rotational driving torque to the nut or bolt head.

The best mode for carrying out the invention is presented in terms of its preferred embodiment, herein depicted within the FIGS. 2–5.

1. Detailed Description of the Figures

Referring now to FIGS. 2–5, an hexagonal wrench socket adapter 100 is shown, according to the present invention, for use with an otherwise conventional ratchet wrench 10 as shown in the PRIOR ART of FIG. 1. The extension 100 has a linearly elongated outer housing having a first end 102 opposite a second end 104. The first end 102 is a cylindrical outer surface having a wrench slider component 105. The wrench slider component 105 forms a standard square receiving cavity 106 for receiving an attachment protuberance 16 of a ratchet wrench 10. The second end 102 thereby forms a square socket drive component 108 that thereby emulates the attachment protuberance 16 of the ratchet wrench 10. It is anticipated that the square socket drive component 108 is formed of standard sized ⅜ inch square socket 109 having a hexagonal bar extension 110 integral with or permanently affixed into the drive socket portion of the square socket drive component 108. With such an arrangement, the slider component 105 forms a ⅜ inch female hexagonal receiving cavity 112 to received the hexagonal bar 110.

It is envisioned that the female hexagonal receiving cavity 112 terminates at the receiving cavity 106. If the wrench slider component has an overall outer length of 2½ inches, only ½ inch would be required as a standard square drive depth for receiving a ratchet wrench; therefore, a total of 1¾ inches is available in which the hexagonal bar extension 110 can slide adjustably within the receiving cavity 112. This allows for an wrench socket adapter that can be telescopingly extended or retracted as the need arises.

The block protuberance receiving cavity 106 is of a common size that allows receiving of the attachment protuberance 16 for purposes of providing a rotational driving torque to the hexagonal wrench 22. The block protuberance receiving cavity 106 is aligned perpendicular to the horizontal planar surface and the hexagonal receiving cavity 110 at the first end 102.

2. Operation of the Preferred Embodiment

To use the present invention in accordance with either embodiment, the extension 100 is placed upon a ratchet wrench 10 such that the attachment protuberance 16 is engaged with the receiving cavity 106. Alternately, the standard sized ⅜ inch square socket 109 removably affixes to a socket 18 selected from a plurality of such units. Each socket 18 includes a recess or cavity 18*a* adapted to receive a specific size nut or bolt head. All sockets 18 include an attachment recess 18*b* of a common size that allows receiving of the attachment protuberance 16 for purposes of providing a rotational driving torque to the nut or bolt head. It is envisioned that wrench slider component can slide adjustably within the receiving cavity 112. This allows for an wrench socket adapter that can be telescopingly extended or retracted as the need arises.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An adjustable socket wrench extension for use with a wrench, said extension comprising:

a linearly, elongated outer housing terminating at two opposing ends;

a first end formed at the distal end of said outer housing, said first end comprises a wrench slider component having a cylindrical outer surface;

a square receiving cavity formed at the exterior end of said wrench slider component to receive the attachment protuberance of a ratchet wrench;

a second end formed at the end opposite said first end, said second end forming an attachment protuberance to engage the attachment recess of a socket; and a hexagonal receiving cavity formed at the internal end of said wrench slider component and terminating at said square receiving cavity, said hexagonal receiving cavity is sized to receive a hexagonal bar extension such that said wrench socket adapter can telescopingly extend or retract as the need arises.

2. The adjustable socket wrench of claim 1, wherein said square receiving cavity is sized to receive said attachment protuberance of said ratchet wrench to provide a rotational driving torque to a socket drive component affixed to said hexagonal bar extension.

3. A wrench socket adapter comprising:

a first end comprising a cylindrical outer surface having a wrench slider component that terminates at a standard square receiving cavity for receiving an attachment protuberance of a ratchet wrench;

a second end opposite said first end comprising a square socket drive component that thereby emulates the attachment protuberance of the ratchet wrench;

wherein said wrench slider component is capable of telescopingly extending or retracting.

4. The wrench socket adapter of claim 3, wherein said square socket drive component is formed of standard sized ⅜ inch square socket having a hexagonal bar extension integral with the drive socket portion of the square socket drive component.

5. The wrench socket adapter of claim 3, wherein said slider component forms a ⅜ inch female hexagonal receiving cavity to receives a hexagonal bar.

6. The wrench socket adapter of claim 3, wherein said wrench socket adapter that can be telescopingly extended or retracted as the need arises.

* * * * *